US006475050B1

(12) United States Patent
Mogi et al.

(10) Patent No.: US 6,475,050 B1
(45) Date of Patent: Nov. 5, 2002

(54) MANUFACTURING METHOD OF IMAGE-FORMING APPARATUS

(75) Inventors: Satoshi Mogi, Kawasaki; Keisuke Yamamoto, Yamato; Tamaki Kobayashi, Isehara, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/505,628

(22) Filed: Feb. 16, 2000

(30) Foreign Application Priority Data

Feb. 25, 1999 (JP) ..... 11-048978
Jan. 27, 2000 (JP) ..... 2000-019151

(51) Int. Cl.[7] ..... H01J 9/02
(52) U.S. Cl. ..... 445/46; 445/24
(58) Field of Search ..... 445/6, 24, 46

(56) References Cited

U.S. PATENT DOCUMENTS 4,251,749 A * 2/1981 Compen et al. ..... 313/479
4,398,869 A * 8/1983 Van Alphen ..... 445/46
4,849,674 A * 7/1989 Cherry et al. ..... 445/6
4,884,010 A 11/1989 Biberian ..... 315/366
5,066,883 A 11/1991 Yoshioka et al. ..... 313/309
5,209,687 A * 5/1993 Konishi ..... 445/6
5,587,720 A * 12/1996 Fukuta et al. ..... 313/309
5,639,356 A * 6/1997 Levine ..... 313/309
5,913,100 A * 6/1999 Kohsaka et al. ..... 313/60
6,038,243 A 3/2000 Mogi ..... 372/50
6,053,791 A * 4/2000 Fujii et al. ..... 445/6

FOREIGN PATENT DOCUMENTS

JP 10-134740 5/1998

* cited by examiner

*Primary Examiner*—Kenneth J. Ramsey
(74) *Attorney, Agent, or Firm*—Fitzpatrick, Cella, Harper & Scinto

(57) ABSTRACT

When high luminance is obtained by increasing an anode voltage in an image-forming apparatus constructed by anode and cathode substrates, a surface discharge (flash over) is generated between anode electrodes at a generating time of an abnormal discharge and an anode is broken. Therefore, as shown in FIG. 3B, the electric potential of an anode electrode on an anode substrate (51) is set to a uniform electric potential V1 by a first power source (53). Thereafter, the first power source (53) is separated from the anode electrode. Subsequently, the electric potential of one of the anode electrodes arranged in proximity to each other through an insulating face is set to an electric potential V2 by a second power sourced (54) to apply a voltage to a cut-in portion (52) (see FIG. 3C). Thus, a voltage Vc equal to or greater than an electric potential difference Ve generated at the generating time of the abnormal discharge is applied to the cut-in portion (52). Thus, the generation of a surface discharge (flash over) in the anode substrate can be prevented at the generating time of the abnormal discharge.

10 Claims, 4 Drawing Sheets

MANUFACTURING METHOD OF IMAGE-FORMING APPARATUS

BACKGROUND OF THE INVENTION

1. Field of the Invention

The present invention relates to a manufacturing method of an image-forming apparatus, and particularly relates to a manufacturing method of an image-forming apparatus of a flat type in which an anode substrate and a cathode substrate are opposed to each other.

2. Related Background Art

In recent years, an image-forming apparatus of a flat type constructed by an anode and a cathode has been widely researched and developed. For example, an electron source used in this image-forming apparatus includes one that is constructed by a field emitter, a surface conduction electron-emitting device, etc. One example using the former field emitter is proposed in U.S. Pat. No. 4,884,010. One example using the latter surface conduction electron-emitting device is proposed in U.S. Pat. No. 5,066,883.

These devices differ from each other in the structure of an electron source, a driving method, etc. However, common features of these devices are that electrons are emitted from the cathode constructed by the electron source with plural electron-emitting devices being arranged, and the anode opposed to the cathode is arranged. This anode has a phosphor and electrons accelerated by an anode voltage are irradiated to the phosphor so that light is emitted from the phosphor and an image is formed.

The distance between this cathode and the anode approximately ranges from several hundred $\mu$m to several mm. The interior of the image-forming apparatus is held in a vacuum. An electric potential of the anode is held approximately with several kilovolts to several tens of kilovolts to obtain luminance by emitting light using the irradiation of an electron beam. An isolation voltage in this portion is secured by a vacuum or an insulator, etc.

In the above image-forming apparatus, when an image is generally formed for a long time by stably emitting electrons, there is a case in which a vacuum arc discharge is observed. An electric current of this abnormal discharge is very large and ranges from several A (ampere) to several hundred A. It is considered that such an abnormal discharge is caused by an insufficient vacuum between the cathode and the anode, an electrode shape, or results of the generation of an abnormal electric field caused by a triple point of a vacuum, an electrode (metal) and an insulating substance.

When such an abnormal discharge is caused once, an electric current is concentrated into this discharge portion and there is a case in which anode and cathode portions are damaged. For example, this vacuum arc discharge causes a large electric current as a result and there is a case in which the electron-emitting device in the cathode is broken by a large amount of Joule heat due to this electric current. The electric potential of wiring for the cathode and connection is unstabilized by the concentration of the electric current. As a result, there is a case in which a device connected through the wiring is damaged.

A technique for arranging a resistor portion in the anode portion is conventionally disclosed in Japanese Patent Application Laid-Open No. 10-134740 to restrain the generation of such a vacuum arc discharge.

SUMMARY OF THE INVENTION

A manufacturing method of an image-forming apparatus in the present invention has the following processes.

Namely, a manufacturing method of an image-forming apparatus having a cathode substrate and an anode substrate opposed to each other is characterized by comprising:

a first setting process for setting the electric potential of an anode electrode formed on the anode substrate to a first electric potential; and a second setting process for setting the electric potential of one portion of the anode electrode to a second electric potential.

The present invention is also characterized in that the anode electrode has a gap in one portion thereof.

The present invention is also characterized in that the anode electrode is constructed by plural anode electrodes and a gap portion is arranged between the anode electrodes.

The present invention is also characterized in that the first and second setting processes are respectively repeated plural times.

The present invention is also characterized in that the cathode substrate has a surface conduction electron-emitting device.

DESCRIPTION OF THE PREFERRED EMBODIMENTS

In a conventional image-forming apparatus, it is most important that no abnormal discharge is caused between an anode and a cathode. However, in reality, for example, it is difficult to perfectly prevent a vacuum arc discharge with good yield in many image-forming apparatuses. Therefore, if the abnormal discharge is caused, it is necessary to take measures for reducing damage. In the following explanation, a substrate forming the anode therein is called an anode substrate and a substrate forming the cathode (an electron-emitting device) therein is called a cathode substrate.

Figure 7A:
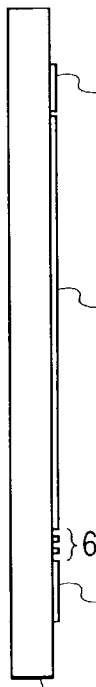
FIGS. 7A and 7B are views typically showing the construction of a conventional anode substrate having a resistor portion in an anode portion.
Figure 7B:
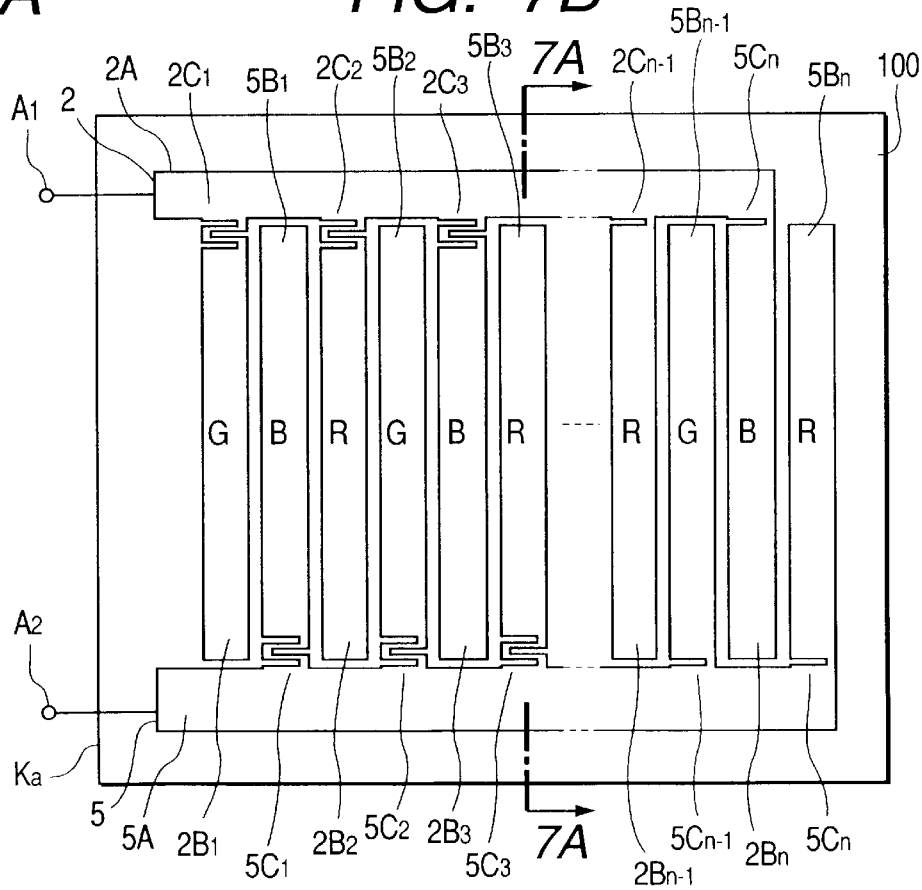

FIGS. 7A and 7B typically show the above technique disclosed in Japanese Patent Application Laid-Open No. 10-134740 and this technique will next be explained schematically. In FIGS. 7A and 7B, reference numeral 100 designates an anode substrate in which plural stripe electrodes (anode electrodes) A, B corresponding to respective colors of R (red), G (green) and B (blue) of a phosphor are formed. A resistor portion C is formed in a lead-out portion of each of these anode electrodes by forming a cut-in portion using laser trimming, etc.

However, an anode voltage disclosed in the above publication approximately ranges from 200 V to 300 V.

Accordingly, a problem exists in that light emitting luminance obtained by an electron beam is weak in the case of such a low voltage. For example, it is necessary to operate the image-forming apparatus (i.e., form an image) by increasing the anode voltage to 5 kV to 15 kV so as to obtain high luminance as in a CRT.

However, when high luminance as in a CRT is obtained by increasing the anode voltage, a voltage drop of the anode reaches the anode voltage (5 kV to 15 kV) at an operating time at a generating time of the vacuum arc discharge. Therefore, a large difference in electric potential is caused in a gap portion of the above anode electrode (each gap between stripe electrodes, or the cut-in portion). Thus, there arises a problem in that a surface discharge (flash over) at said gap portion is generated by this electric potential difference so that the anode electrode is broken.

The present invention has been made to solve the above-mentioned problems, and has an object to provide an image-forming apparatus and its manufacturing method capable of preventing the generation of a surface discharge (flash over) in an anode substrate at the generating time of an abnormal discharge in the image-forming apparatus having cathode and anode substrates opposed to each other.

One embodiment mode of the present invention will next be explained in detail with reference to the drawings.

<Schematic Construction>

Figure 1:
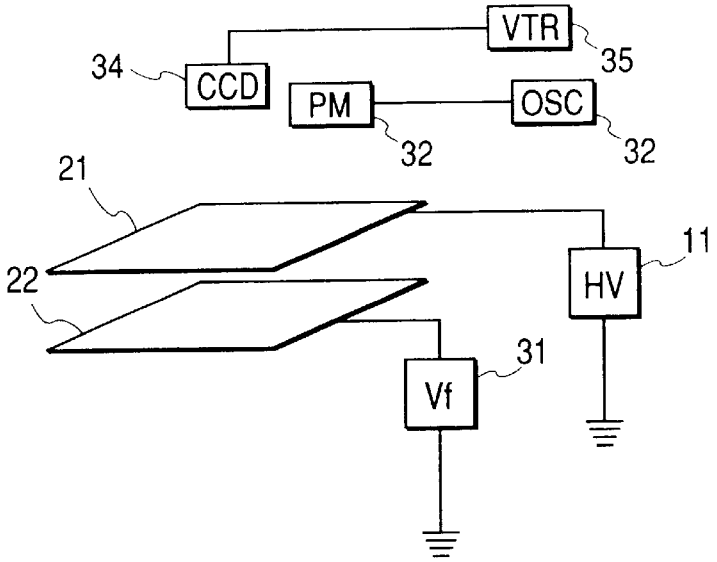
FIG. 1 is a view showing the construction of an image-forming apparatus to which one embodiment mode of the present invention can be applied.

FIG. 1 is a view typically showing one example of an image-forming apparatus to which the present invention can be applied. In FIG. 1, reference numerals 21, 22 and 11 respectively designate an anode substrate, a cathode substrate forming an electron-emitting device therein, and a high voltage power source. Reference numerals 31, 32 and 33 respectively designate a power source for operating devices, a photomultiplier and an oscilloscope. Reference numerals 34 and 35 respectively designate a CCD camera and a VTR.

A high positive electric potential from several tens of kilovolts to several ten kilovolts, preferably equal to or greater than 5 kV and equal to or lower than 15 kV is applied to an anode electrode arranged on the anode substrate 21 to make the construction shown in FIG. 1 function as an image-forming apparatus. This electric potential is applied to give a sufficient accelerating voltage for emitting light from a phosphor with sufficient luminance to an electron beam emitted from the cathode. An electron emitted from the electron-emitting device formed in the cathode substrate 22 emits light from the phosphor formed in the anode substrate 21 by this electric potential. In this case, a flow of the electron should be distinguished from "abnormal discharge" in this embodiment. The anode substrate 21 and the cathode substrate 22 are normally held in a vacuum and the distance between the anode substrate 21 and the cathode substrate 22 becomes smaller than a mean free path of the emitted electron. Concretely, the distance between the anode substrate 21 and the cathode substrate 22 ranges from several hundred $\mu$m to several mm and preferably ranges from 200 $\mu$m to 5 mm, and is further preferably set to a distance which is equal to or greater than 1 mm and is equal to or smaller than 3 mm.

In the construction shown in FIG. 1, there is a case in which the abnormal discharge is suddenly observed. No generating factor of this discharge can be clarified. However, for example, it is considered that a problem exists in that an electrode shape formed in the cathode substrate 22 causes an abnormal electric field, etc. For example, the generation of the abnormal discharge can be specified by observing light emission of the image-forming apparatus by using the photomultiplier 32, etc. Namely, strong light emission is observed by the abnormal discharge.

Figure 2A:
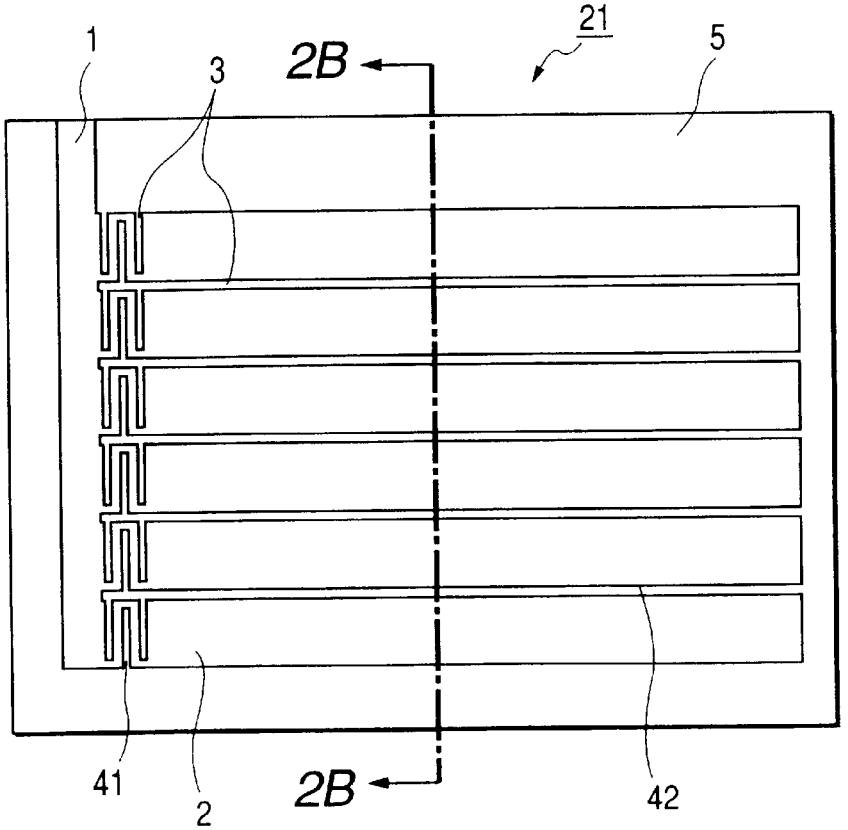
FIGS. 2A and 2B are views showing the construction of an anode substrate in this embodiment mode.
Figure 2B:
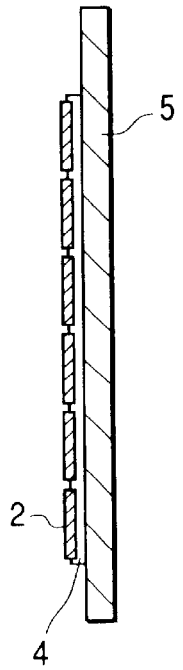

FIGS. 2A and 2B are typical views of the anode substrate preferably applicable to the image-forming apparatus of the present invention and show a detailed construction of the anode substrate 21 shown in FIG. 1. FIG. 2A is a plan view of the anode substrate 21 and FIG. 2B is a cross-sectional view taken along the line 2B—2B shown in FIG. 2A.

An anode electrode of the image-forming apparatus preferably applying the present invention thereto has a gap in one portion thereof.

In FIGS. 2A and 2B, reference numerals 1, 2, and 3 respectively designate a high voltage taking-out portion for applying a high voltage required to accelerate an electron beam, a metal back (anode electrode), and a cut-in portion (gap portion) in which no metal back 2 is formed by patterning the metal back 2. Reference numerals 4 and 5 respectively designate a film (image forming member) constructed by a phosphor, and a glass substrate (anode substrate). In the example shown here, the cut-in portion (gap portion) 3 is divided into an electrode cut-in portion (first gap) 41 and an interelectrode cut-in portion (second gap) 42. This cut-in portion 3 is arranged such that the anode electrodes are oppositely arranged through an insulator (the phosphor film 4 and the anode substrate 5). The present invention is not limited to the anode electrode in a form shown in FIGS. 2A and 2B. For example, the present invention can be also applied to an anode electrode in a form shown in FIGS. 7A and 7B.

When the abnormal discharge is partially generated in the anode substrate 21 constituting the construction shown in FIGS. 2A and 2B, the inventors of this application have found that an electric charge Q accumulated between the cathode and the anode electrode in a discharging portion flows along a discharging path, and an electric potential of the anode electrode in the discharging portion is reduced to an electric potential of the cathode. It is observed that a speed required for this reduction is several hundred ns, depending on the distance between the anode and the cathode.

A difference in electric potential close to a voltage applied to the anode electrode is generated by this abnormal discharge between anode electrodes (hereinafter, simply call "proximate electrodes") arranged in proximity to each other through the insulator on the anode substrate 21. There is a case in which a surface discharge (flash over) is caused between the proximate electrodes by this generation of the electric potential difference. The anode electrode is generally constructed by a very thin conductive film such as a conductive film having a thickness from several hundred Å to several thousand Å. Therefore, an electric charge released by the surface discharge (flash over) may be reduced by patterning the anode electrode, but has energy sufficient to break the anode electrode in the image-forming apparatus having high voltage applied to the anode.

Beginning of the surface discharge (flash over) is characterized by its starting voltage. In contrast to this, the inventors have found that the starting voltage of the surface discharge is increased by repeating the surface discharge. Accordingly, if the surface discharge can be induced in a manufacturing process of the anode substrate 21 without breaking the anode electrode to such an extent that no anode electrode can be used, the starting voltage of the surface discharge in the manufactured anode substrate 21 is increased. Therefore, when this anode substrate is subsequently used in the image-forming apparatus, the generation of the above surface discharge can be restrained. Therefore, this embodiment mode is characterized in that the surface discharge (flash over) on an insulator (along with a surface of an insulator) in the above gap portion is induced in the manufacturing process of the anode substrate 21 without breaking the anode electrode to such an extent that no anode electrode can be used.

<Explanation of Principle>

Figure 3A:
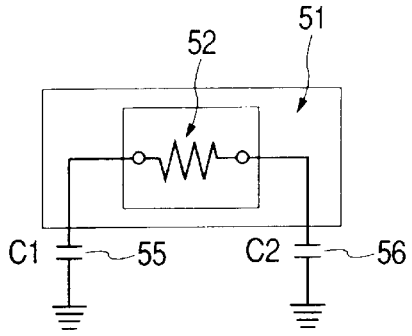
FIGS. 3A, 3B and 3C are views typically showing a voltage setting process to an anode substrate by an equivalent circuit in this embodiment mode.
Figure 3B:
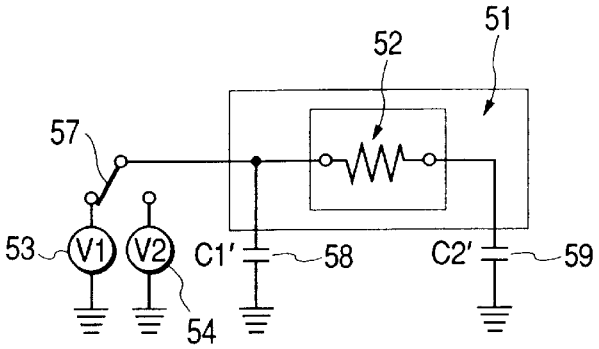
Figure 3C:
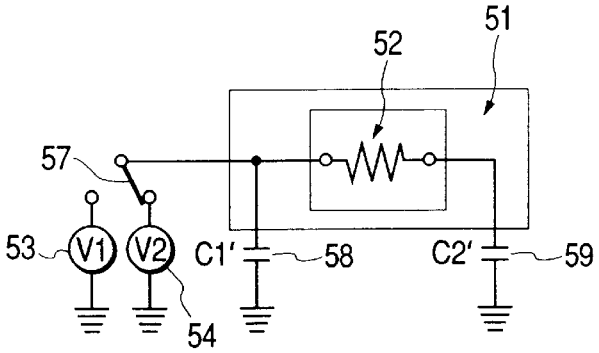

FIG. 3A is a view typically showing the anode substrate 21 capable of applying this embodiment mode by using an equivalent circuit. FIGS. 3B and 3C are views explaining a voltage setting process in this embodiment mode.

In FIGS. 3A to 3C, reference numeral 51 designates an anode substrate. Reference numeral 52 designates a cut-in portion (gap portion). An insulating face is equivalently shown by a resistor to show the structure in which anode electrodes are arranged in proximity to each other through the insulating face. Each of capacitors C1, C2 on sides of anode electrodes 55, 56 corresponds to a capacity formed between the ground and each of the anode electrodes arranged in proximity to each other through the insulating face (insulator in said gap portion). Reference numerals 53, 54, and 57 respectively designate a first power source for setting the anode electrodes to a first electric potential V1, a second power source for setting the anode electrodes to a second electric potential V2, and a switch for connecting the anode electrodes and the power sources.

Here, when an abnormal discharge is generated on the side of the anode electrode 55, energy E released by the surface discharge corresponds to energy accumulated to the capacitor C2 formed between the anode electrode 56 and the cathode. When an electric potential difference generated between the anode electrodes 55 and 56 at a time of the abnormal discharge, i.e., the electric potential difference in the cut-in portion 52 is set to Ve, this energy is expressed as follows.

$$E=C2\cdot Ve\hat{}2/2 \quad (1)$$

In this embodiment mode, ^ shows power and e.g., A^r shows r-power of A.

When the anode substrate 21 is generally used in the image-forming apparatus, the distance between the anode substrate 21 and the cathode substrate 22 approximately ranges from several hundred μm to several mm. The electric potential difference Ve generated in the gap portion of the anode electrode at the time of the abnormal discharge reaches a voltage applied to the anode electrode at an operating time of the image-forming apparatus, and ranges from several kV to several tens of kV. Therefore, there is a case in which the anode electrode is broken by this energy.

Accordingly, to prevent the breakage of the anode electrode due to the abnormal discharge, it is necessary to guarantee that no surface discharge is generated by the electric potential difference Ve generated in the cut-in portion 52. Therefore, it is necessary to guarantee an isolation voltage by increasing a starting voltage of the surface discharge by applying a voltage equal to or greater than the electric potential difference Ve in advance. When the surface discharge is also induced by applying the electric potential difference Ve, it is necessary to improve the isolation voltage by repeating the surface discharge. At this time, it is necessary to limit an electric current so as not to break the anode electrode by the surface discharge.

This embodiment is characterized in that the isolation voltage is increased in the manufacturing process of the anode substrate while the above electric current control is performed.

<Schematic Explanation of Voltage Setting Process>

A voltage setting process in this embodiment mode will next be explained schematically.

As shown in FIG. 3B, an electric potential of the anode electrode on the anode substrate 51 is set to a substantially uniform electric potential V1 by the first power source 53. In this case, the voltage is slowly applied in comparison with a change in voltage due to the abnormal discharge so as not to generate the electric potential difference in the cut-in portion (gap portion) 52. Here, since the change in electric potential at the time of the abnormal discharge is a high speed phenomenon of several hundred ns (nanosecond), a large electric potential difference is generated in the cut-in portion 52 at the generating time of the abnormal discharge. Accordingly, when the voltage is applied, the electric potential difference can be restrained to be sufficiently small if it takes several tens μs (micro-second) or more at the rising of this voltage. After the anode electrode is set to the uniform electric potential V1, the first power source 53 is separated from the anode electrode.

Subsequently, as shown in FIG. 3C, an electric potential of one of the anode electrodes arranged in proximity to each other through the insulating face (insulator in the gap portion) is set to an electric potential V2 by the second power source 54 so as to apply the voltage to the cut-in portion (gap portion) 52. Thus, a voltage Vc equal to or greater than the electric potential difference Ve generated at the generating time of the abnormal discharge is applied to the cut-in portion 52. The above electric potential V2 is preferably an electric potential lower than the above electric potential V1 and is more preferably a GND electric potential.

For example, when |V2-V1| is approximately the same voltage as a voltage (electric potential difference) Va applied between the anode electrode and the cathode electrode at a time used in the image-forming apparatus, it is necessary to set a speed for setting to the above electric potential V2 to be faster than that at a time required in a change in voltage due to the abnormal discharge generated at the time used in the image-forming apparatus.

In the voltage setting process in this embodiment, it is preferable to reduce a capacity of the capacitor formed by the anode electrodes such that no anode electrodes are broken at the generating time of the surface discharge. As one technique for realizing this, the distance between the anode substrate 51 and a member having a ground electric potential or an electric potential applied to the cathode in an operation of the image-forming apparatus is set to be sufficiently large so that a capacitor C of a low capacity is formed. It is possible to cope with the above distance by setting this distance to be larger than the distance between the anode electrode (anode substrate) and the cathode (cathode substrate) when these members are assembled into the image-forming apparatus. Thus, in this embodiment, energy E released at the generating time of the surface discharge is expressed as follows.

$$E=C'\cdot Vc\hat{}2/2 \quad (2)$$

Accordingly, the energy can be restrained in comparison with the above-mentioned formula (1).

[Embodiments]

A manufacturing method of the anode substrate in this embodiment mode will next be explained in detail in accordance with real examples.

[Embodiment 1]

This embodiment shows the manufacturing method of the anode substrate shown in FIGS. 2A and 2B.

First, an anode substrate is coated with a black stripe and a phosphor by sedimentation, and is then baked so that an image display face is formed. The phosphor is then coated with an acrylic emulsion and so-called filming known as smoothing processing of a phosphor face is performed. Thereafter, an aluminum film is evaporated such that this aluminum film has about 50 nm in thickness. The aluminum film is baked in the air to evaporate organic substances of a filming component. Next, the aluminum film is cut by a laser trimming method so that a pattern shape shown in FIGS. 2A and 2B is obtained.

The voltage setting process used in this embodiment is next executed.

Figure 4:
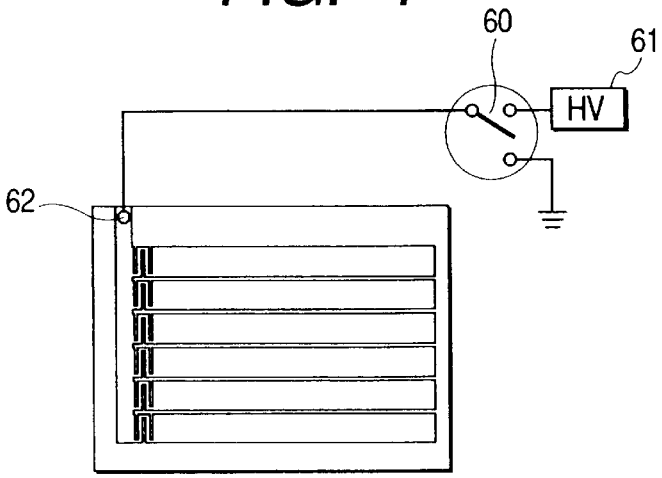
FIG. 4 is a view explaining a voltage setting process in this embodiment mode.

In the voltage setting process, the anode substrate is arranged on an insulating substrate having 10 cm in height such that the side of an anode electrode is directed upward. Thus, the distance between the anode electrode and the ground is also set to about 10 cm. As shown in FIG. 4, a taking-out portion of the anode electrode is then connected to a switch 60 by a probe 62. After the switch 60 is connected to a high voltage power source 61, a voltage is increased to 12 kV. Subsequently, the switch 60 is short-circuited to a ground electric potential. Here, a high voltage semiconductor switch is used as the switch 60 and an electric potential changing speed in the probe portion 62 in switching is set to 80 ns.

In this process, light emission is observed in an electrode cut-in portion. When this process is repeated four times, no light emission is observed.

Figure 5:
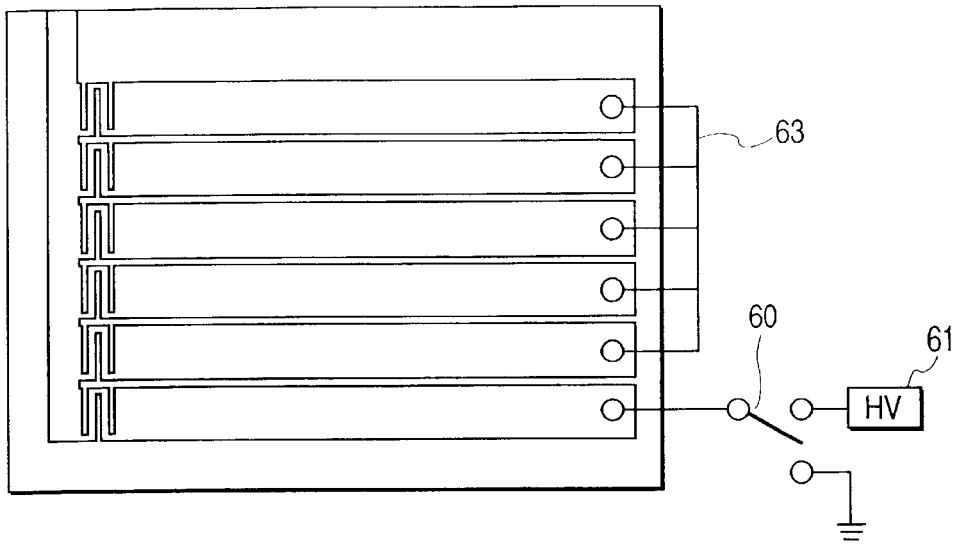
FIG. 5 is a view explaining the voltage setting process in this embodiment mode.

Subsequently, as shown in FIG. 5, probing is performed and one portion of the anode electrode is connected to the switch 60 and the remaining portions are connected to a common wiring 63. When the voltage is applied and a switching operation is performed in a method similar to that in FIG. 4, light emission is observed in an interelectrode cut-in portion. When this process is repeated seven times, no light emission is observed. The voltage setting process is repeatedly performed by the similar method with respect to each anode electrode.

When the anode electrode is observed after completion of the entire voltage setting process, no generation of a damaged portion is recognized.

Figure 6:
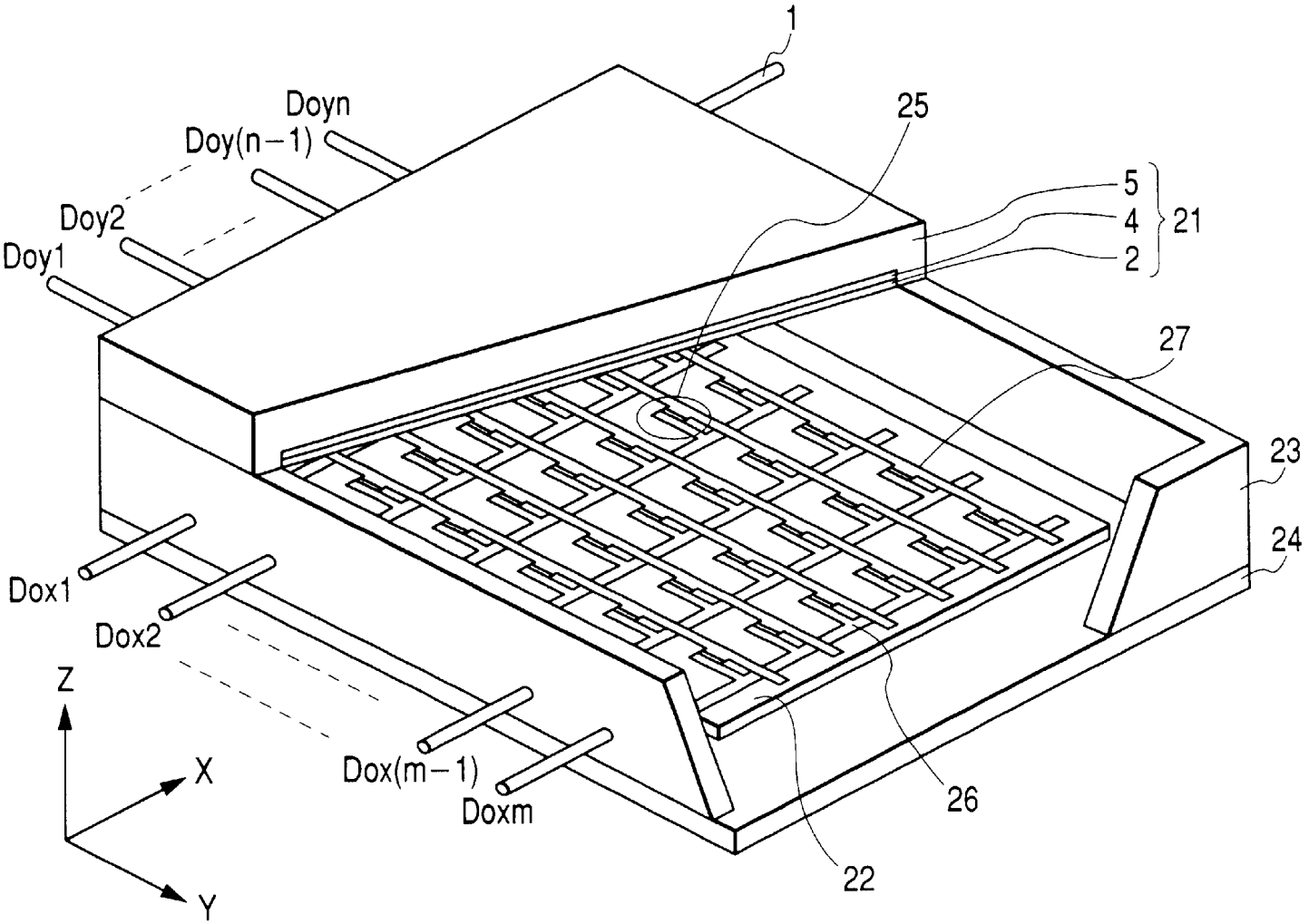
FIG. 6 is a view showing the construction of the image-forming apparatus made by using the anode substrate in this embodiment mode.

An image-forming apparatus is manufactured using the anode substrate prepared through the above process. FIG. 6 is a view typically showing the construction of the image-forming apparatus made by using the anode substrate in this embodiment.

Similar to the above FIG. 1, reference numerals 21 and 22 in FIG. 6 respectively designate an anode substrate and a cathode substrate. Similar to the above FIGS. 2A and 2B, the anode substrate 21 is constructed by a metal back 2, a phosphor 4 and a glass substrate 5 and has a high voltage taking-out portion 1. Reference numerals 23, 24, and 25 respectively designate a supporting frame for fixing the anode substrate 21 and the cathode substrate 22, a rear plate for supporting the cathode substrate 22, and a surface conduction electron-emitting device formed on the cathode substrate. Reference numerals 26 and 27 respectively designate an x-directional wiring and a y-directional wiring.

In the construction shown in FIG. 6, a high voltage of 10 kV is applied to the anode substrate 21 and a driver unit (not shown) connected to the x-directional wiring 26 (concretely, Dox1, Dox2, . . . Dox(m−1), Doxm) of the cathode substrate 22 and the y-directional wiring 27 (concretely, Doy1, Doy2, . . . Doy(n−1), Doyn) is operated so that an image can be displayed. While various kinds of images are displayed in this state, a durable test of 700 hours is made so that four abnormal discharges are detected by measuring light emission intensity of the photomultiplier 32.

However, no light emission is observed in the cut-in portion in any case. Namely, it is confirmed that no surface discharge is generated. After the above durable test is terminated, it is inspected whether or not a defect is caused in the cathode substrate 22 and the anode substrate 21. However, no damage is particularly confirmed.

As explained above, in accordance with this embodiment mode, the surface discharge is generated in a limiting state of an electric current in advance in formation of the anode substrate so that an isolation voltage can be improved without damaging the anode electrode. Accordingly, not only the yield of the anode substrate is improved, but the surface discharge generated in the cut-in portion can be prevented at a generating time of the abnormal discharge. Therefore, it is possible to provide an image-forming apparatus holding a stable display quality for a long time.

In this embodiment, the surface conduction electron-emitting device is used as an electron-emitting device, but the present invention is not limited to this surface conduction electron-emitting device. For example, a field emitter, an MIM type electron-emitting device, etc. can be preferably applied to the present invention.

As explained above, in accordance with the present invention, the generation of the surface discharge in the anode substrate can be prevented at the generating time of the abnormal discharge in the image-forming apparatus having the cathode and anode substrates opposed to each other.

What is claimed is:

1. A manufacturing method of an image-forming apparatus, the image-forming apparatus having a cathode substrate on which an electron-emitting device is disposed, and an anode substrate on which an anode electrode is disposed, with a space between the anode substrate and the cathode substrate being held in a pressure-reduced state, said method comprising:

(A) a first setting process for setting the electric potential of the anode electrode formed on the anode substrate to a first electric potential; and (B) a second setting process for setting the electric potential of one portion of the anode electrode to a second electric potential, wherein said processes (A) and (B) are performed without electron emission from the electron-emitting device.

2. A manufacturing method of an image-forming apparatus, the image-forming apparatus having a cathode substrate on which an electron-emitting device is disposed, and an anode substrate on which an anode electrode is disposed, with a space between the anode substrate and the cathode substrate being held in a pressure-reduced state, said method comprising:

(A) a step of preparing the anode substrate on which the anode electrode and a phosphor are disposed;

(B) a step of preparing the cathode substrate on which the electron-emitting device is disposed;

(C) a first setting process for setting the electric potential of the anode electrode to a first electric potential;

(D) a second setting process for setting the electric potential of a portion of the anode electrode to a second electric potential; and (E) a step of disposing the anode substrate and the cathode substrate in opposition to each other, and sealing the anode substrate and the cathode substrate to hold a reduced pressure between the anode substrate and the cathode substrate, wherein said step (E) is performed after said steps (C) and (D).

3. A manufacturing method of an image-forming apparatus, the image-forming apparatus having a cathode substrate on which an electron-emitting device is disposed, and an anode substrate on which an anode electrode is disposed, with a space between the anode substrate and the cathode substrate being held in a pressure-reduced state, said method comprising:

(A) a first setting process for setting the electric potential of the anode electrode to a first electric potential; and (B) a second setting process for setting the electric potential of a portion of the anode electrode to a ground electric potential, wherein the first electric potential is higher than the second electric potential.

4. A manufacturing method of an image-forming apparatus according to any one of claims 1, 2 and 3, wherein a gap is formed in a part of the anode electrode.

5. A manufacturing method of an image-forming apparatus according to any one of claims 1, 2 and 3, wherein the anode electrode is constructed by plural anode electrodes and a gap portion is arranged between different anode electrodes.

6. A manufacturing method of an image-forming apparatus according to any one of claims 1, 2 and 3, wherein said first and second setting processes are respectively repeated plural times.

7. A manufacturing method of an image-forming apparatus according to claim 6, wherein said first and second setting processes are respectively repeated until no discharge in said anode electrode is observed.

8. A manufacturing method of an image-forming apparatus according to any one of claims 1, 2 and 3, wherein the electric potential is set by switching a high voltage power source and the ground in said first and second setting processes.

9. A manufacturing method of an image-forming apparatus according to any one of claims 1, 2 and 3, further comprising a step of providing at a first distance from the anode electrode, a member having an electric potential substantially equivalent to the electric potential applied to an electrode formed on the cathode in operating the image-forming apparatus, wherein, when the image forming apparatus is assembled, the first distance between the member and the anode electrode is larger than the distance between the anode and cathode electrodes.

10. A manufacturing method of an image-forming apparatus according to any one of claims 1, 2 and 3, wherein an electrostatic capacity formed by the anode substrate in said first and second setting processes is smaller than a capacity provided when the anode substrate is used in the image-forming apparatus.

* * * * *

UNITED STATES PATENT AND TRADEMARK OFFICE

CERTIFICATE OF CORRECTION

PATENT NO. : 6,475,050 B1
DATED : November 5, 2002
INVENTOR(S) : Satoshi Mogi et al.

It is certified that error appears in the above-identified patent and that said Letters Patent is hereby corrected as shown below:

Column 3,
Line 37, “several tens of” should read -- several --; and
Line 38, “ten” should read -- tens of --.

Column 4,
Line 43, “call” should read -- called --.

Column 6,
Line 2, “embodiment mode” should read -- embodiment --.

Column 10,
Line 18, “distance between the member and the anode” should read -- distance --; and
Line 19, “electrode is” should read -- is --.

Signed and Sealed this

Fourth Day of November, 2003

JAMES E. ROGAN
*Director of the United States Patent and Trademark Office*